United States Patent [19]

Tong

[11] 4,019,738

[45] Apr. 26, 1977

[54] GAME DEVICE AND GAME

[76] Inventor: Te-Kong Tong, 370 15th St., Norwood, N.J. 07648

[22] Filed: May 17, 1976

[21] Appl. No.: 687,095

Related U.S. Application Data

[63] Continuation of Ser. No. 592,890, July 3, 1975, abandoned.

[52] U.S. Cl. ..... 273/106 R; 273/106 A

[51] Int. Cl.[2] ..... A63B 67/18

[58] Field of Search ..... 273/106 R, 106 A, 106.5 A

[56] References Cited

UNITED STATES PATENTS

| | | | |
|---|---|---|---|
| 1,831,230 | 11/1931 | Copas | 273/106 A UX |
| 3,378,260 | 4/1968 | Hartel | 273/106.5 A X |
| 3,784,202 | 1/1974 | Pon | 273/106 A |
| 3,829,094 | 8/1974 | Goldfarb et al. | 273/106.5 A X |
| 3,834,705 | 9/1974 | Wong | 273/106 A |

FOREIGN PATENTS OR APPLICATIONS

| | | | |
|---|---|---|---|
| 617,068 | 3/1961 | Canada | 273/106 A |
| 1,126,988 | 8/1956 | France | 273/106.5 A |
| 589,208 | 6/1947 | United Kingdom | 273/106.5 R |

*Primary Examiner*—Paul E. Shapiro

[57] ABSTRACT

A game device that is adapted to move back and forth between different parts of the body and a game to play involving the same. The device comprises a pot bellied shaped structure with a flat bottom. Extending from the top of the structure is a shaft portion with a non-circular cross section and an axle with an enlarged distal end. A bowl shaped braking member surrounds the shaft portion for sliding movement thereon and a wheel member surrounds the axle for sliding and rotary movement thereon. A plurality of feathers mounted to the wheel member.

8 Claims, 6 Drawing Figures

GAME DEVICE AND GAME

This application is a continuation in part of application Ser. No. 592,890, filed on July 3, 1975 and now abandoned, the benefit of which filing date is claimed.

BACKGROUND OF THE INVENTION

This invention relates to a game device that may be used by one person or by a group during game play. More particularly, the invention relates to a game device that is adapted to be moved about between various parts of the body of the player and between various players.

The game is basically designed as a one-man game for individuals of all ages, for both fun as well as physical exercise. It is to be played individually without a playmate, though individuals can also play together. Unlike the shuttlecock in a badminton game which moves back and forth between opposing players, the instant device moves up and down, being kicked by one player.

The device is to be kicked with the inner side of the foot (along the planter's arch) with a sudden bending of the leg. With sufficient practice, the player may use other parts of the body for returning the device to the foot for further kicking. With advanced skill, the player may master kicking two or more devices at the same time.

The prior art teaches game devices that fall within the general family to which the instant device is directed, for example, U.S. Pat. Nos. 2,012,730; 2,153,251; 2,613,935; 2,911,219; 3,091,460; and others. These devices as well as the games to be played therewith are distinguishable from the instant game in that the shuttlecock is different as are the rules of the game.

SUMMARY OF THE INVENTION

It is accordingly an object of the instant invention to provide for a new and yet simple game.

It is another object of the invention to provide for a game device of the character described.

These and other objects of the invention will become more apparent from the following detailed disclosure and claims and by reference to the accompanying drawings, in which:

Figure 1:
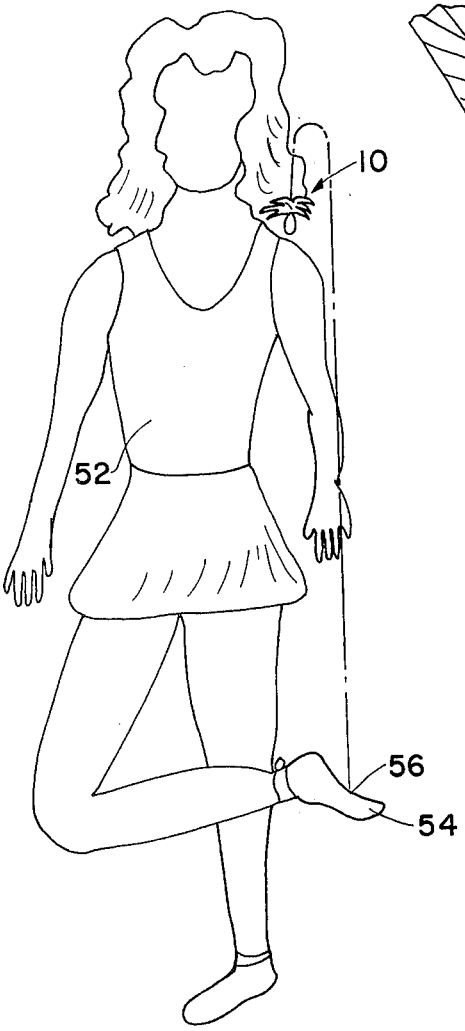
FIGS. 1 and 5 are elevational views in perspective of an individual illustrating the manner in which the game device is employed and two views of the device in motion.
Figure 2:
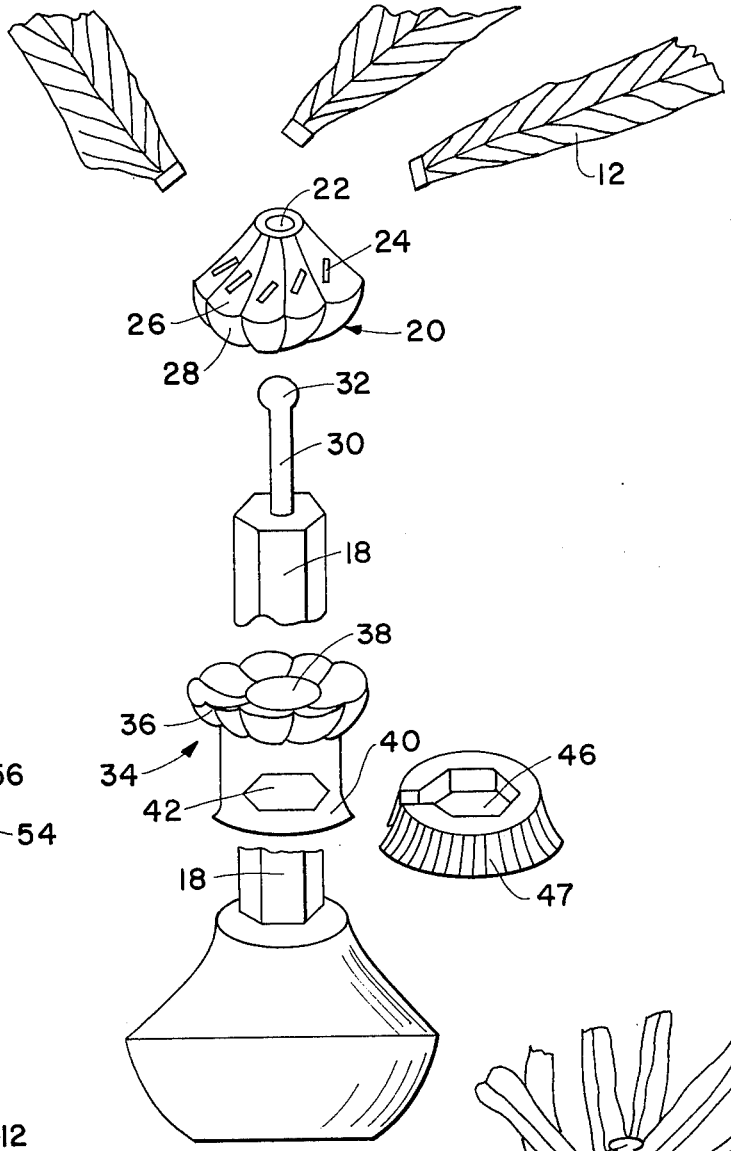
FIG. 2 is an exploded view showing the game device.

Broadly speaking, the instant invention includes the provision of a game device comprising a generally pot bellied bottle shaped structure having a base portion and a conical lower wall portion forming an angle of greater than about 90° therewith, the conical lower wall portion upwardly and outwardly extending from the base portion and then reversing direction and inwardly tapering continuously to form an arcuate shaped upper wall potion having varying diameter of steadily reducing dimension, an elongated shaft in longitudinal alignment with the structure and upwardly extending therefrom, the shaft terminating in an axle member having an enlarged distal head, the axle member having a lesser diameter than that of the shaft, the shaft having a non-circular cross-section, the axle portion having a circular cross-section, a bowl shaped braking member defining a first aperture having a non-circular cross-section corresponding to that of the shaft, the first aperture having a diameter greater than the external diameter of the shaft, the shaft communicating with the aperture, the member adapted to slide upon the shaft, a wheel member defining a second aperture, the second aperture having a circular cross-section, the member disposed on the axle portion, the member having a truncated cone shaped upper section and a bowl shaped lower section, the lower section having an external shape corresponding to the inner shape of the braking member; the wheel member adapted to slide and rotate about the axle portion, the axle member being at least as long as the depth of the wheel member, the truncated cone shaped upper section defining a plurality of slotted apertures, at least one feather like projection disposed in each of the slotted apertures, the braking member adapted to slide along the shaft between the wall portion and the wheel member.

DETAILED DESCRIPTION

Referring more particularly to the drawings, there is shown a shuttlecock like device 10 which includes a plurality of feather like projections 12, a body 14 that includes a champagne or pot bellied bottle shaped main structure, i.e., a three sided trapezoid shaped lower section that upwardly, inwardly tapers to form an elongated neck portion 16 having an arcuate shape that communicates with a plurality of removable members through a shaft 18.

The plurality of members includes a wheel member 20 that has a central aperture 22 therein for receiving the shaft 18 therethrough. The wheel 20 is preferably bulb shaped and defines a plurality of slotted apertures 24 thereon that receive and retain the feathers 12. The slotted apertures are preferably disposed at an angle of 45° relative to the shaft 18. In this manner, the feathers 12 and the wheel 20 will rotate clockwise as air moves against the feathers 12 as the device is propelled through the air.

The wheel 20 which may also be categorized as a rotor rotates automatically when the device 10 is flying down toward the earth. The rotation can be stopped periodically by an automatic brake 34 as described hereinafter or permanently by a lock 44 as also later more fully discussed. A shrill sound is produced during motion of the device 10.

The wheel 20 is shaped such that the upper portion 26 thereof is tapered in an upward direction toward the aperture 22 such that a reduced diameter is defined. A plurality of vertical planes or projections are formed therein. The lower portion 28 thereof forms a bowl shaped pan or tray having a plurality of vertical planes that are adapted to receive and seat the base of the wheel 20 therein via the plurality of vertical planes thereon. The internal surface of the pan 28 conforms to the external surface of the wheel 20 such that it is operative to arrest the revolution of the wheel 20, as described later.

The shaft 18 is generally hexagonally shaped in cross-section and extends upwardly from the body 14, an axle portion 30 is seated on the top of the shaft 18 and has a reduced diameter relative to that of the shaft 18, terminating in an enlarged head 32. The head 32 protruding out of the apertures 22 when the wheel 20 is seated on the axle portion 30. A braking member 34 has an upper portion 36 similar in shape to portion 28 and has a cooperating vertical plane structure, and defines an aperture 38 therein. The portion 36 will not rotate about the shaft 18 but is operative to only move upward and downward thereon, this is accomplished by having the aperture 38 have a hexagonal cross-section corresponding to that of the shaft 18. The lower portion 40 of the member 34 is cylindrical shaped and also has a central aperture 42 therein corresponding in cross-section to that of the shaft 18. The shaft 18 will be of sufficient length to permit the members to move upward and downward thereon. Since the brake 34 is able to move up and down on the shaft 18 but does not rotate when the object 10 is in the upright position (such as flying downward in the air), the gravity of the earth will pull and release the brake 34, the wheel 20 then will turn like that on a helicopter. But if the object 10 is flying upside down (as being kicked into the air), the gravity of the earth will pull the brake 34 onto the lower part of the wheel 20 and brake it from rotating.

As is apparent from the foregoing, the brake member 34 is operative to move upward and downward along the length of the shaft 18 forward and away from the wheel 20. Since the inner surface of the member 34 conforms to the outer surface of the wheel 20, when the member 34 meets the wheel 20, it is operative to arrest the movement thereof by locking thereagainst. The plurality of planes vertically disposed on the interior surface of the brake 34 engaging the corresponding planes on the exterior surface of the wheel 20.

A removable lock or collar 44 is adapted to be engaged to the lower portion of the shaft 18 just above the neck 16 and below the brake 34 thereby effectively arresting it all times it is thereon, the rotation of the wheel 20 about the axle portion 30. The locking collar 44 has an aperture 46 that corresponds in cross-section to that of the shaft 18. The collar 44 may either be slid onto the shaft 18 or contain a split thereon (i.e., a split ring) and be constructed of a semi-flexible material such that it may be snapped onto the shaft 18 without sliding the same thereon. In the embodiment where the collar 44 is on the shaft 18, only projections 12 serve as flight influencing means, i.e., a parachute to control the dropping speed of the device 10 rather than as a mere stabilizer as in badminton. The speed of descent in this embodiment may be adjusted if desired by varying the size of the projections 12. The device 10 may further include a weight means 48 disposed at the outer or inner surface of the base 49 thereof. Speed of descent may also be varied by varying the weight. The device 10 is shape retaining and is preferably constructed of a rigid, solid material able to withstand the abuse to which the same is put, i.e., plastic, hard rubber, etc.

Advantageously, at least the lower portion of the body 14 will be covered with a fibrous or felt like surface so as to protect the device 10 and to soften the impact thereof against the player's body.

Figure 3:
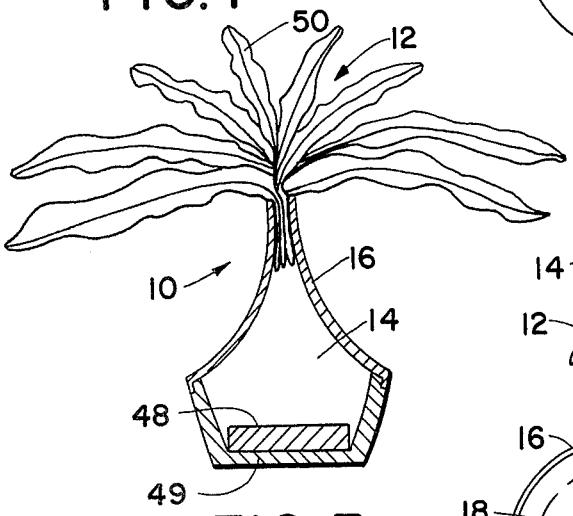
FIG. 3 is a sectional view.
Figure 5:
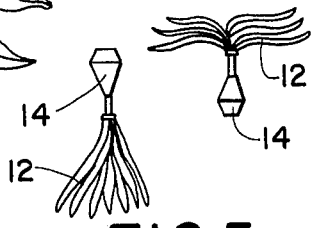
Figure 4:
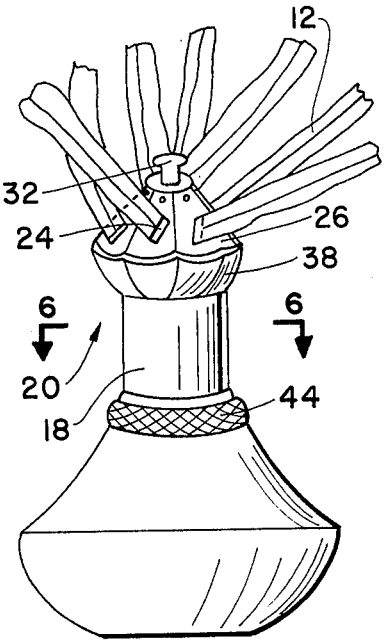
FIG. 4 is a front elevational view.
Figure 6:
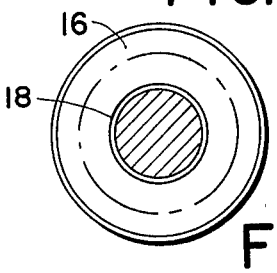
FIG. 6 is a section taken along the line 6—6 of FIG. 4.

As can be appreciated from FIG. 3, the stems 50 of the projections 12 are angularly spread from where the same are in communication with the neck 16 of the device 10. The stems 50 are generally constructed of a flexible material such as plastic, rubber, etc., and will generally define an irregular shape, though elongated.

The game, as aforesaid, may be played by an individual 52 kicking the device by having one foot 54, specifically the planter's arch 54 thereof come in contact with the device 10, the device 10 is then made to contact another portion of the body via the aforesaid flight whereupon it is permitted to drop towards the floor for subsequent upward motion by the foot 54 again.

Since it is obvious that numerous changes and modifications can be made in the above-described details without departing from the spirit and nature of the invention, it is to be understood that all such changes and modifications are included within the scope of the invention.

I claim:

1. A game device comprising a generally pot bellied bottle shaped structure having a base portion and a conical lower wall portion forming an angle of greater than about 90° therewith, said conical lower wall portion upwardly and outwardly extending from said base portion and then reversing direction and inwardly tapering continuously to form an arcuate shaped upper wall portion having a varying diameter steadily reducing dimension, an elongated shaft in longitudinal alignment with said structure and upwardly extending therefrom, said shaft terminating in an axle member having an enlarged distal head, said axle member having a lesser diameter than that of said shaft, said shaft having a non-circular cross-section, said axle portion having a circular cross-section, a bowl shaped braking member defining a first aperture having a non-circular cross-section corresponding to that of said shaft, said first aperture having a diameter greater than the external diameter of said shaft, said shaft communicating with said aperture, said member adapted to slide upon said shaft, a wheel member defining a second aperture, said second aperture having a circular cross-section, said member disposed on said axle portion, said member having a truncated cone shaped upper section and a bowl shaped lower section, said lower section having an external shape corresponding to the inner shape of said braking member; said wheel member adapted to slide and rotate about said axle portion, said axle member being at least as long as the depth of said wheel member, said truncated cone shaped upper section defining a plurality of slotted apertures, at least one feather like projection disposed in each of said slotted apertures, said braking member adapted to slide along said shaft between said wall portion and said wheel member.

2. The device as defined in claim 1 wherein said slotted apertures are disposed at an angle of about 45° relative to said shaft.

3. The device as defined in claim 1 wherein said shaft has at least a three sided shape in cross-section.

4. The device as defined in claim 1 wherein said structure includes weight means disposed in communication with at least one surface of said base portion.

5. The device as defined in claim 1 further including a collar defining a central aperture, said central aperture having a cross-section corresponding to that of said shaft.

6. The device as defined in claim 5 wherein said collar is a split ring.

7. A device as defined in claim 1 wherein a least a portion of said structure is covered with a fibrous material.

8. The device as defined in claim 1 wherein said braking member includes a cylindrical base portion depending from said bowl shaped member.

* * * * *